US006183281B1

(12) United States Patent
Wu et al.

(10) Patent No.: US 6,183,281 B1
(45) Date of Patent: Feb. 6, 2001

(54) ELECTRICAL CONNECTOR

(75) Inventors: Ming-Chuan Wu, Shun-Lin; Da-Ching Lee, Tu-Chen, both of (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/422,279

(22) Filed: Oct. 20, 1999

(51) Int. Cl.[7] ..... H01R 13/62
(52) U.S. Cl. ..... 439/260; 439/607; 439/497
(58) Field of Search ..... 439/260, 267, 439/607, 329, 495, 497, 609, 610

(56) References Cited

U.S. PATENT DOCUMENTS 5,370,552 * 12/1994 Chishima et al. ..... 439/495
5,401,186 * 3/1995 Nozaki et al. ..... 439/260
5,474,468 * 12/1995 Chishima et al. ..... 439/495
5,580,272 * 12/1996 Yamaguchi et al. ..... 439/260
5,738,545 * 4/1998 Igarashi et al. ..... 439/607

* cited by examiner

*Primary Examiner*—Gary F. Paumen
(74) *Attorney, Agent, or Firm*—Wei Te Chung

(57) ABSTRACT

A flexible cable connector comprises an insulative housing, a plurality of terminals retained in the housing, a stuffer and a conductive shield partially surrounding the housing. A plurality of passageways is defined in the housing for receiving the terminals. Each terminal has a terminal member and a contact member for engaging with a mating connector. The flexible cable is inserted into the housing from a rear edge thereof and a signal pattern of the flexible cable is adapted to engage with the terminal members of the terminals. The shield forms a pressing plate to engage with a grounding pattern of the flexible cable. The stuffer is assembled in the housing for pressing against the pressing plate.

1 Claim, 7 Drawing Sheets

ELECTRICAL CONNECTOR

BACKGROUND OF THE INVENTION

The present invention relates to an electrical connector, and especially to an electrical connector for connecting with a flexible cable and having a stuffer for abutting the flexible cable in contact with a plurality of terminals.

An electrical connector for connection with a flexible cable, i.e. a FPC (Flexible Printed Circuit), usually comprises an insulative housing and an EMI shield adapted to surround the housing. A plurality of terminals is assembled in the housing proximate a mating face thereof. The flexible cable is inserted into the housing from a mounting face of the housing opposite the mating face to contact the terminals. An actuator is pivotally mounted to the housing proximate the mounting face and rotated to press against the flexible cable thereby securing the flexible cable within the housing and facilitating connections between the terminals and the FFC. Pertinent prior arts are disclosed in US. Pat. Nos. 5,370,552; 5,401,186; 5,474,468; 5,580,272; and 5,738,545.

Referring to FIGS. 6 and 7, a conventional electrical connector 6 for connection with an FPC 7 comprises an insulative housing 60 and a first conductive shield 61 adapted to partially surround the housing 60. A plurality of passageways 600 is defined through the housing 60 for receiving corresponding terminals 62. Each terminal 62 includes contact portions 610 and a terminal portion 620 opposite the contact portions 610. The FPC 7 is inserted into the housing 60 from a rear surface thereof and a signal pattern 71 of the FPC 7 contacts the terminal portions 620 of the terminals 62. An actuator 63 is pivotally mounted to the housing 60 proximate the rear surface. A second shielding shield 70 partially surrounds the pressing member 63. The pressing member 63 is rotated to press against the FPC 7 around a predetermined axis X thereby securing the FPC 7 within the housing 60 and providing a reliable engagement between the signal pattern 71 of the FPC 7 and the terminal portions 620. Simultaneously, the second shield 70 contacts a grounding conductor 72 of the FPC 7.

Due to current trends, different components of a device are often manufactured at different plants. The components are then transported to another plant to complete assembly of the device. Thus, a structure of each component must be suitable for long distance transportation. However, the second shield and the pressing member may be damaged after colliding with other parts of the connector or with unexpected objects outside the connector during transportation due to the pivotal engagement between the pressing member and the housing. Furthermore, the pressing member and the second shield have a complex structure thereby making manufacture both time and cost inefficient.

SUMMARY OF THE INVENTION

Accordingly, the primary object of the present invention is to provide an electrical connector for connection with a flexible cable having a stuffer for abutting the flexible cable into contact with a plurality of terminals.

A second object of the present invention is to provide an electrical connector for connection with a flexible cable and which has a simple structure and is easily manufactured.

A third object of the present invention is to provide an electrical connector for connection with a flexible cable and which facilitates survives after long distance transportation.

To fulfill the above-mentioned objects, an electrical connector for connection with a flexible cable comprises an insulative housing, a plurality of terminals retained in the housing and a conductive shield partially surrounding the housing. A plurality of passageways is defined between a front surface and a rear surface of the housing for receiving the terminals. Each terminal has a terminal member and a contact member for engaging with a mating connector. The flexible cable is inserted into the housing from the rear surface and a signal pattern of the flexible cable is adapted to engage with the terminal members of the terminals. The shield forms a pressing plate for engaging with a grounding pattern of the flexible cable. A stuffer is inserted into the housing for pressing against the pressing plate thereby forcing the pressing plate in contact with the flexible cable.

Other objects, advantages and novel features of the invention will become more apparent from the following detailed description when taken in conjunction with the accompanying drawings.

DETAILED DESCRIPTION OF A PREFERRED EMBODIMENT

Figure 1:
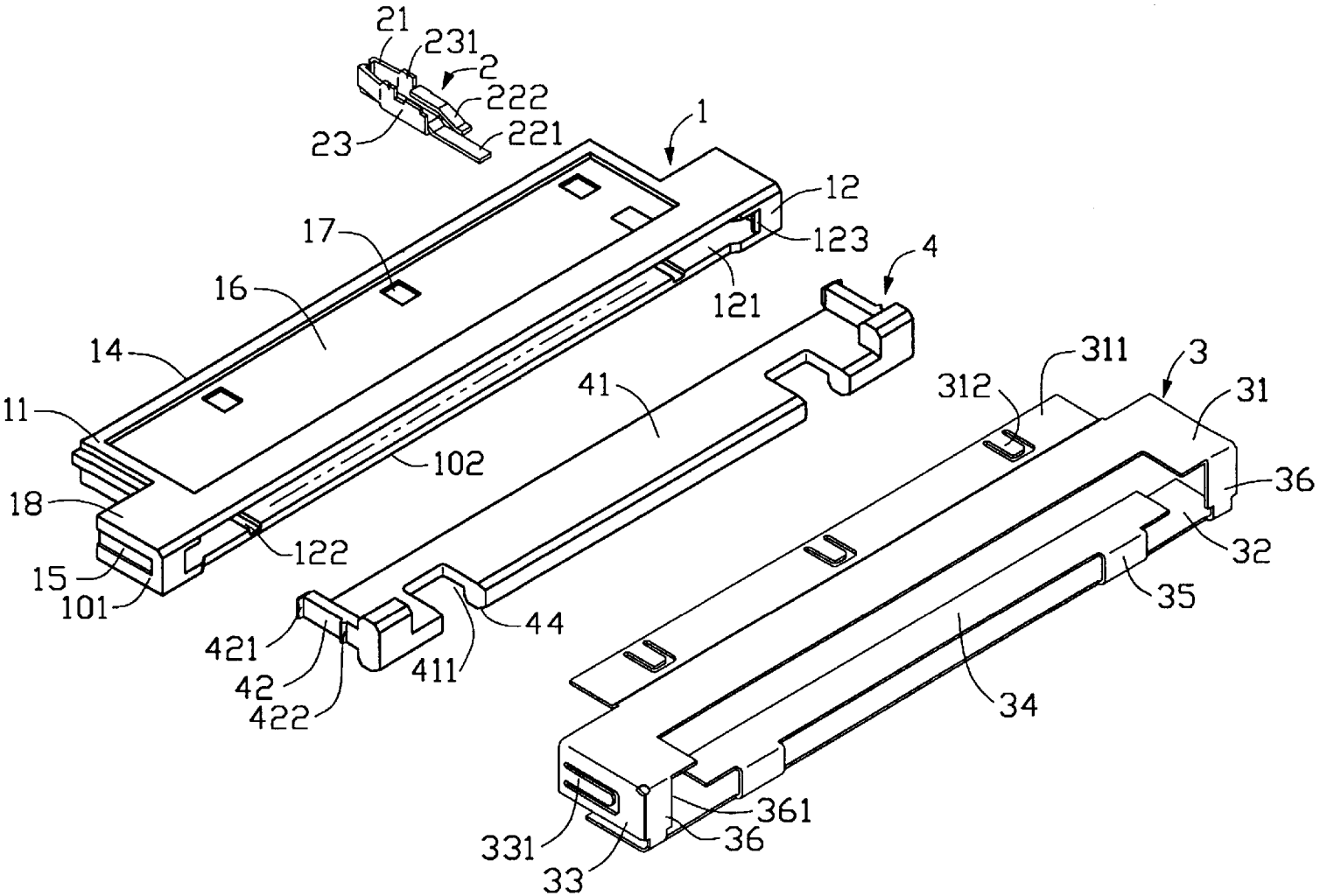
FIG. 1 is an exploded bottom view of an electrical connector for connecting with a flexible cable in accordance with the present invention.
Figure 2:
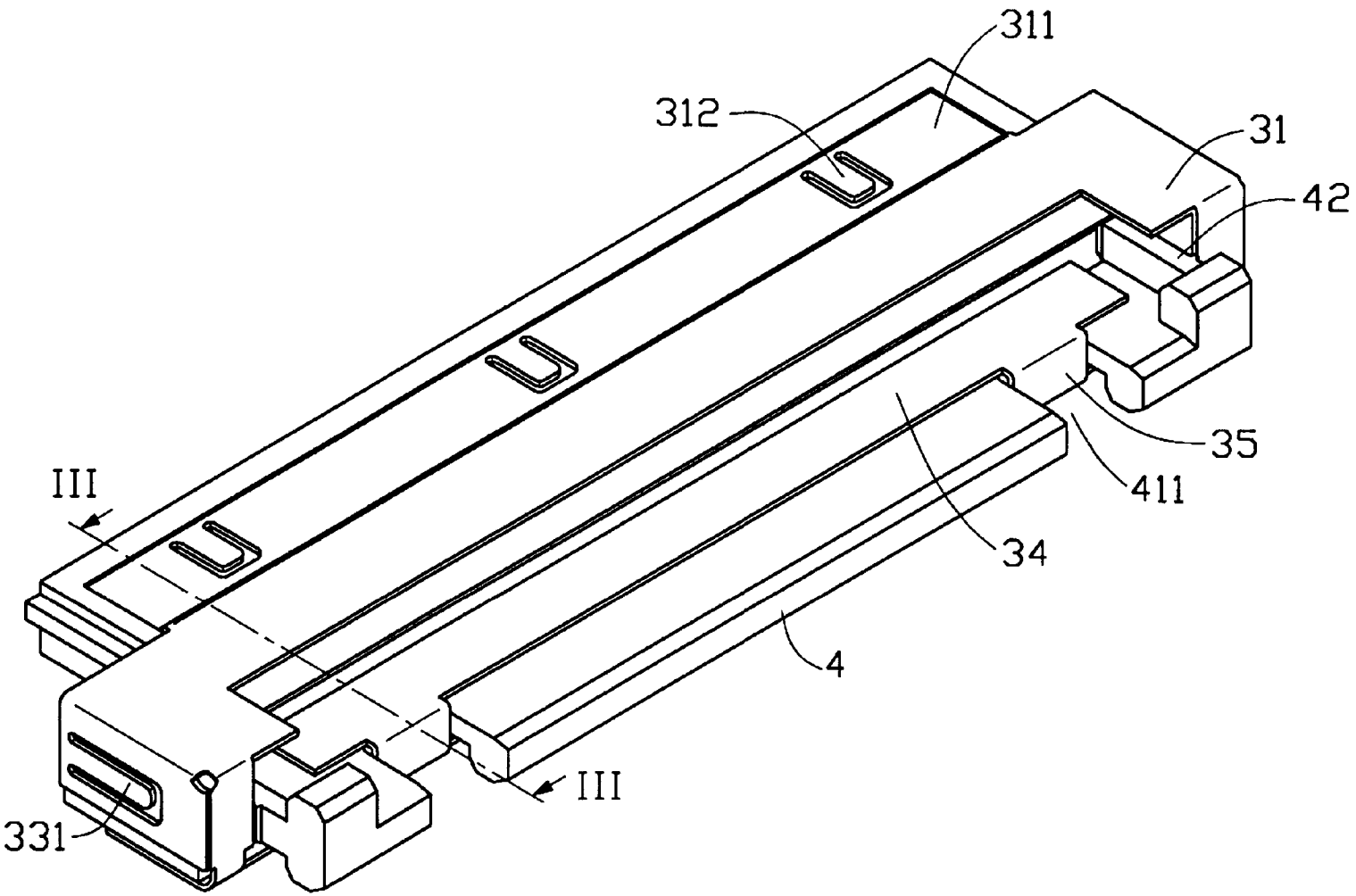
FIG. 2 an assembled view of FIG. 1.

Referring to FIGS. 1 and 2, an electrical connector in accordance with the present invention comprises an insulative housing 1, a plurality of terminals 2 (only one of which is showed in the drawing) retained in the housing 1, a shield 3 and an elongate stuffer 4.

The housing 1 includes a forwardly extending mating projection 11. The housing 1 has a front surface 14 and a rear surface 12. A plurality of passageways 124 (FIG. 3) is defined between the front surface 14 and the rear surface l2 for receiving the terminals 2. The passageways 124 have stepped portions 122 recessing into the housing 1. An elongate slot 121 is defined in the rear surface 12 in communication with the passageways 124. A pair of latches 123 is formed at opposite ends of the slot 121. A shallow area 16 is defined in a bottom surface 18 of the housing 1. Three parallel spaced recesses 17 are defined within the shallow area 16. A groove 15 is defined in each of opposite lateral surfaces 101 of the housing 1.

Each terminal 2 is unitarily stamped to include three contact strips 21 at one end thereof, first and second terminal strips 221, 222 at the other end thereof, and a center portion 23 between the contact strips 21 and the terminal strips 221, 222. Locking blocks 231 are formed on edges of the center portion 23 for being interferentially fit in the corresponding passageway 124. The second terminal strip 222 is shorter than the first terminal strip 221 and has a curved end bent toward the first terminal strip 221.

The stuffer 4 includes an elongate body 41, a pair of fasteners 42 at opposite ends of the body 41, and an elongate flange 44 upwardly projecting at a rear edge of the body 41. Each fastener 42 forms a first locking barb 421 and a second locking barb 422 projecting at an outward side thereof. The first locking barb 421 is located proximate a distal end of the fastener 42. A pair of cutouts 411 is defined at the rear edge of the body 41.

Figure 3:
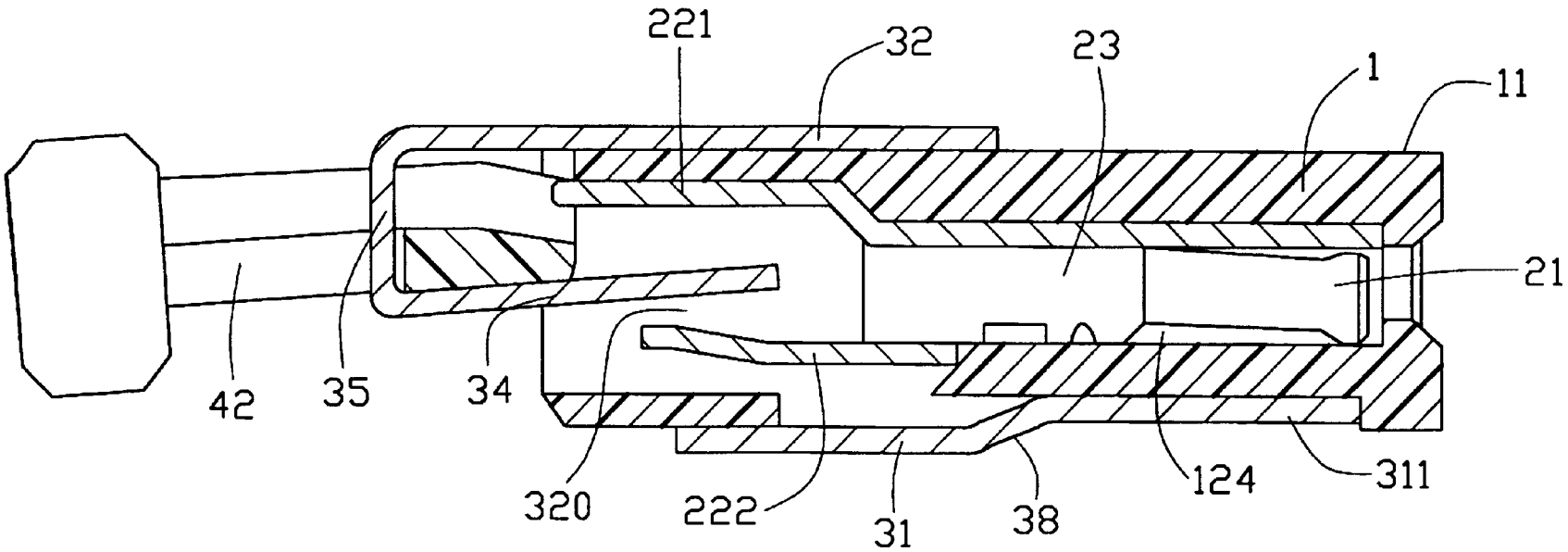
FIG. 3 is a cross-sectional view of the FIG. 2 viewed from line III—III.
Figure 4:
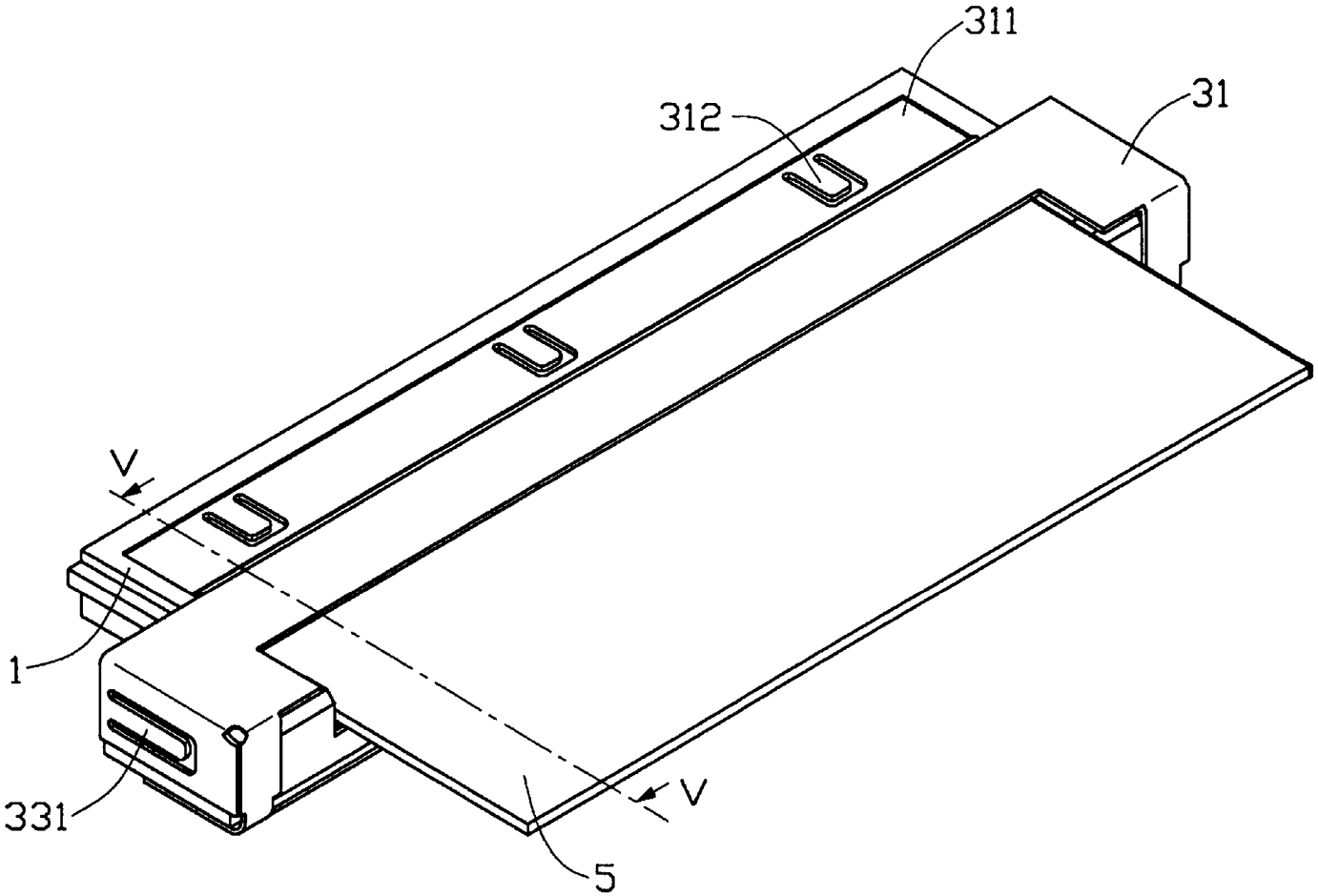
FIG. 4 is similar to FIG. 2 wherein a flexible cable is inserted into the electrical connector.

The shield 3 is unitarily stamped to include a top wall 32, a bottom wall 31, and a pair of lateral walls 33 for cooperatively defining a space to accommodate the housing 1. The bottom wall 31 is adapted to cover the bottom surface 18 of the housing 1. The lateral walls 33 downwardly extend from opposite ends of the bottom wall 31 and are adapted to cover the opposite lateral surfaces 101 of the housing 1. An inwardly stamped tab 331 is formed in each lateral wall 33. The top wall 32 is adapted to cover a top surface 102 of the housing 1 and connects with the bottom wall 31 via a pair of rear walls 36 which covers the rear surface 12 of the housing 1. The shield 3 includes an elongate fixing plate 311 parallel to the bottom wall 18 and connecting the bottom wall 18 via an inclined transition portion 38 (FIGS. 3 and 4). Three parallel spaced and inwardly stamped lances 312 are formed in the fixing plate 311 corresponding to the recesses 17 of the housing 1. The shield 3 includes an elongate pressing plate 34 parallel to the top wall 32 and connecting to the top wall 32 via a pair of linkers 35.

Also referring to FIGS. 2 and 3, in assembly, the terminals 2 are received in the corresponding passageways 124 from the rear surface 12 with the first terminal strips 221 resting within the stepped portions 122.

To assemble the stuffer 4 into the shield 3, inner edges 361 of the rear walls 36 ride over the second locking barbs 422 and the linkers 35 are received in the cutouts 411. The inner edges 361 are movable between the first and second locking barbs 421, 422.

To assemble the assembly of stuffer 4 and shield 3 to the housing 1, the bottom wall 31 covers the bottom surface 18 of the housing 1 with the fixing plate 311 resting within the shallow area 16 with the lances 312 engaging the recesses 17. Moreover, the lateral walls 33 cover the lateral surfaces 101 of the housing 1 with the tabs 331 engaging the grooves 15. The top wall 32 covers the top surface 102 of the housing 1. The stuffer 4 is manually pushed inward to a provisionally-retained condition where the first locking barbs 421 snap over the latches 123.

In this provisionally-retained condition, a gap 320 is defined between the pressing plate 34 and the second terminal strips 222 for extension of the flexible cable 5.

Figure 5:
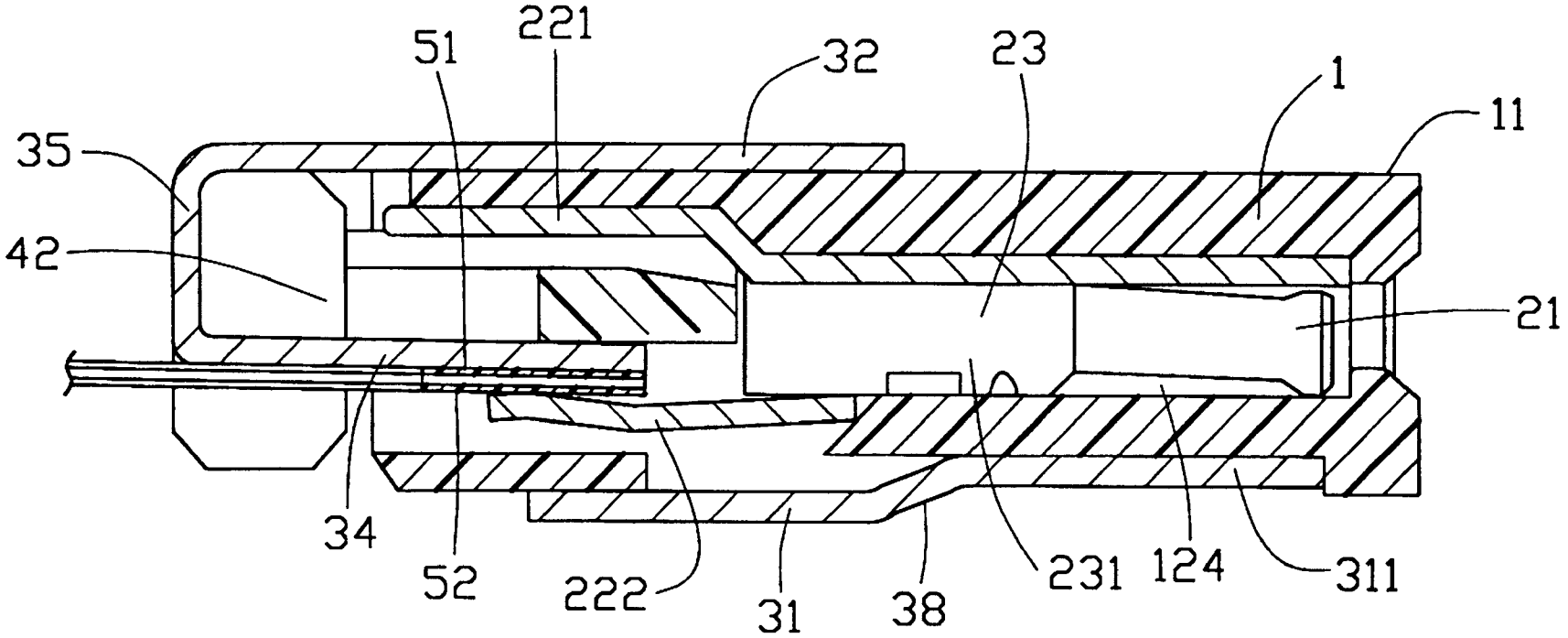
FIG. 5 is a cross-sectional view of FIG. 4 viewed from line V—V.
Figure 6:
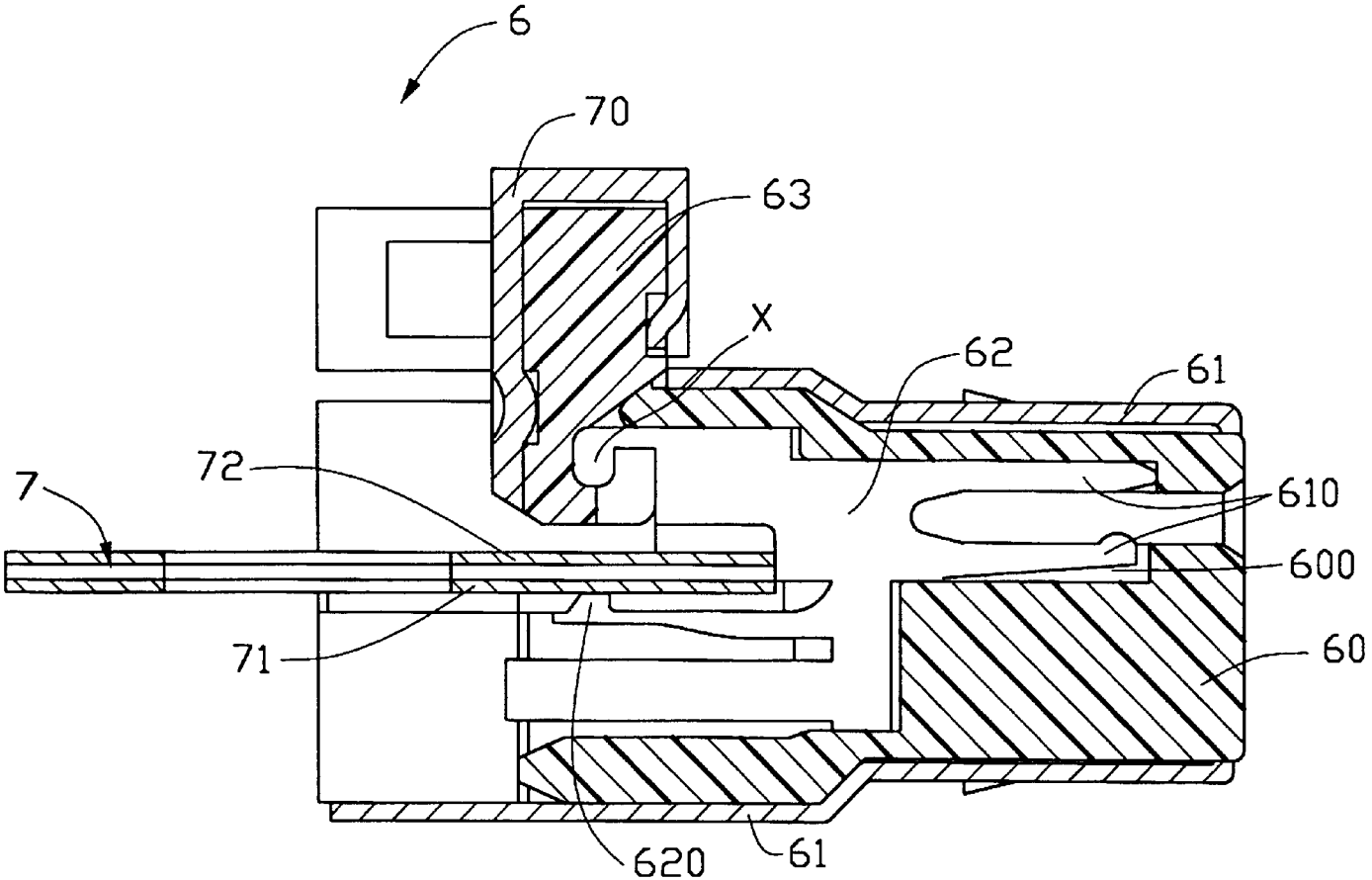
FIG. 6 (PRIOR ART)
FIG. 6 is a cross-sectional view of a conventional electrical connector for connecting with a flexible cable.
Figure 7:
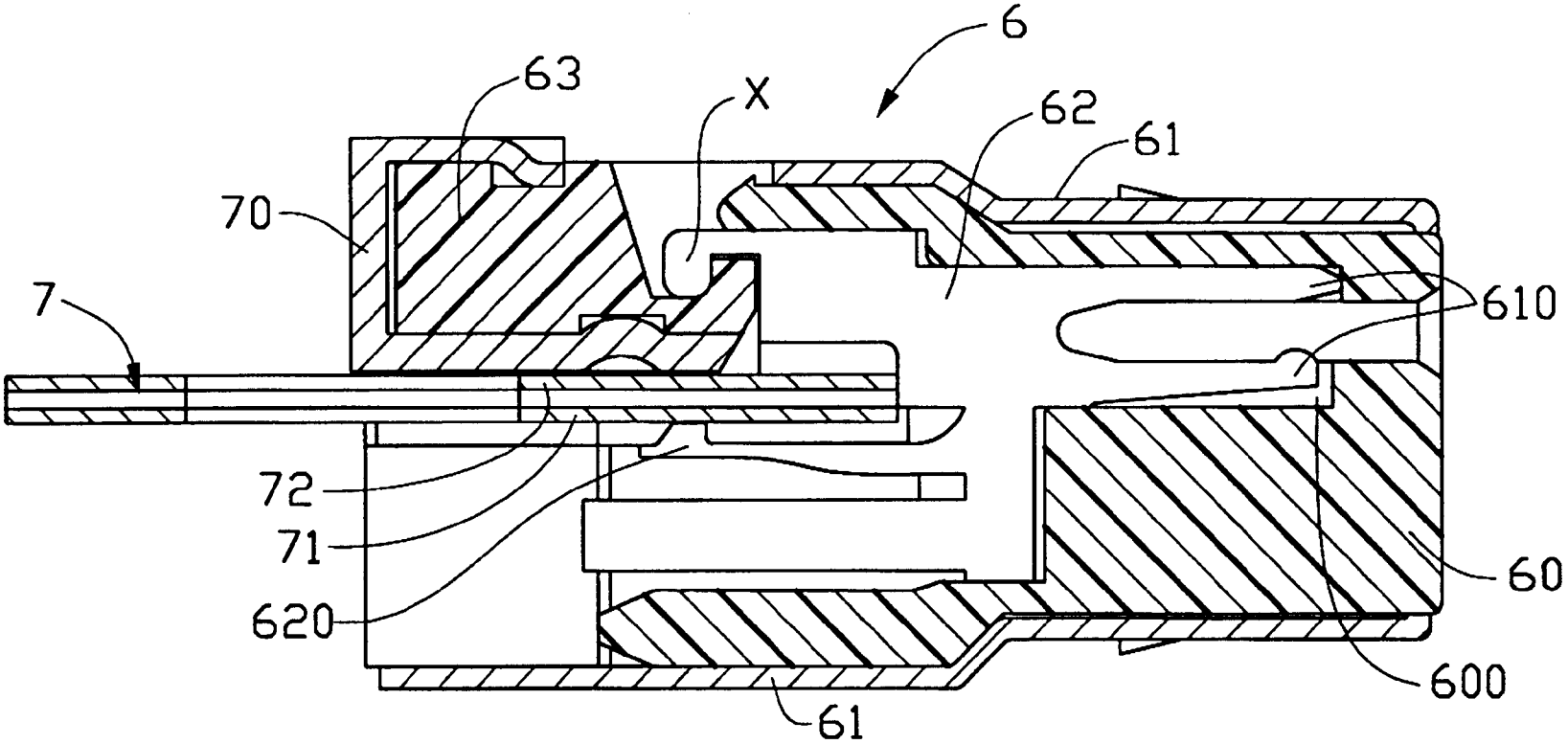
FIG. 7 (PRIOR ART)
FIG. 7 is similar to FIG. 6 showing a pressing member being rotated to press against the flexible cable.

Also referring to FIGS. 4 and 5, the flexible cable 5 is inserted into the electrical connector from a rear edge thereof. A leading edge of the flexible cable 5 extends through the gap 320. The lead edge of the flexible cable 5 includes a grounding pattern 51 on a face-up side thereof facing the pressing plate 34 and a signal pattern 52 on an opposite side thereof facing the first terminal strips 222. The stuffer 4 is further pushed inward from the provisionally-retained condition to a fully-retained condition.

In this fully-retained condition, the second locking barbs 422 snap over the inner edge 361 of the rear wall 36 of the shield 3. The flange 44 abuts against a rear edge of the top wall 32 to force the stuffer 4 to downwardly press against the pressing plate 34. Therefore, the pressing plate 34 contacts the grounding pattern 51 of the flexible cable 5 and the signal pattern 52 of the flexible cable 5 contacts the second signal strips 222.

In this embodiment, a mating header connector (not shown) includes a plurality of contacts adapted to be inserted into the electrical connector from the front surface to engage the terminals 2. The mating header connector connects to a PCB (Printed Circuit Board). Thus, a signal path between the PCB and the flexible cable is established.

When the assembled electrical connectors are required to be transported, the stuffers may be disassembled from the connectors. Thus, the stuffer will not be damaged by colliding with other parts of the connector or other random objects during excessive vibration. Furthermore, the structure of the connector is simple thereby making manufacture time and cost efficient and facilitating automatic manufacture.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flexible cable electrical connector comprising:

an insulative housing defining a plurality of passageways and a slot at a rear edge thereof in communication with the passageways;

a plurality of terminals retained in the passageways;

a metal shield securely enclosing the housing, the shield including a pressing plate extending into the slot; and a stuffer movably received within the shield to urge the pressing plate into contact with a flexible cable inserted between the terminals and the pressing plate;

wherein the stuffer includes a pair of fasteners at opposite ends thereof, and wherein a pair of latches if formed at opposite ends of the slot, the fasteners being adapted to engage the latches;

wherein each fastener includes a pair of locking barbs;

wherein the stuffer includes a pair of cutouts, the shield includes a top wall and a bottom wall, and a pair of linkers connects the pressing plate and the top wall, the linkers being received in the cutouts, the shield having a pair of rear walls with inner edges adapted to engage with the locking barbs.

* * * * *